United States Patent [19]

Ruckstuhl

[11] Patent Number: 4,896,999

[45] Date of Patent: Jan. 30, 1990

[54] SET OF CONCRETE BUILDING BLOCKS FOR CONSTRUCTING A DRY WALL

[76] Inventor: Willi Ruckstuhl, Augwilerstrasse 48, CH-8302 Kloten, Switzerland

[21] Appl. No.: 278,733

[22] Filed: Dec. 1, 1988

[30] Foreign Application Priority Data

Dec. 1, 1987 [DE] Fed. Rep. of Germany ..... 3740646

[51] Int. Cl.[4] ..... F02D 29/02

[52] U.S. Cl. ..... 405/286; 52/596; 52/604; 405/284; 405/262

[58] Field of Search ..... 405/284, 285, 286, 287, 405/273, 258, 262; 52/598, 604, 596, 593

[56] References Cited

U.S. PATENT DOCUMENTS

| | | | |
|---|---|---|---|
| 1,851,959 | 3/1932 | Huntoon | 405/273 |
| 1,871,439 | 8/1932 | Alexander | 405/273 |
| 1,871,488 | 8/1932 | Alexander | 405/273 |
| 2,949,704 | 8/1960 | Jacobs | 52/596 X |
| 3,873,225 | 3/1975 | Jakobsen et al. | 52/604 X |
| 4,521,138 | 6/1985 | Steiner | 405/284 |

*Primary Examiner*—Dennis L. Taylor
*Attorney, Agent, or Firm*—Thomas W. Speckman; Douglas H. Pauley

[57] ABSTRACT

A wall block set comprising frontal blocks, anchoring blocks and connecting blocks. The frontal blocks have a forward side with a texture similar to natural stone, and have dovetail projections which are integrally formed on the rear side of the frontal block. The frontal blocks having a base width are inserted in irregular alternation. Another type of front side has a hollow shape and therefore permits planting of foliage. The anchoring blocks and connecting blocks form distancing elements with dovetail projections, lying opposite to one another, with the same dimension as the projections of the frontal blocks. Through the interlacing of the frontal blocks with these anchoring and connecting blocks, double-faced dry walls of various thicknesses, as well as slope walls, which are secured on the slope by means of retainers, may be constructed.

13 Claims, 7 Drawing Sheets

5
5'
10
16
17
4
9
B
1.5B
2B
1

SET OF CONCRETE BUILDING BLOCKS FOR CONSTRUCTING A DRY WALL

BACKGROUND OF THE INVENTION

1. Field of the Invention

This invention relates to concrete building stones or blocks for constructing a dry wall. The dry wall construction depends on positioning the building blocks so that a single-faced or double-faced wall can be constructed without requiring a connecting mass, such as mortar, between the blocks.

2. Description of the Prior Art

For construction on slopes, it is desirable to anchor a dry wall within the actual slope, so that it can serve to secure the inclination. Furthermore, it is often desirable to plant foliage within the blocks of the wall.

SUMMARY OF THE INVENTION

According to this invention, the building blocks provide easy construction for a dry wall.

According to a preferred embodiment of this invention, a set of concrete building blocks includes frontal blocks, anchoring blocks, and connecting blocks. Every frontal block has a textured front side and has at least one projection which is dovetailed, as viewed in the cross section, on its rear side. Every anchoring block is, in cross section, a rectangle with a dovetail integrally formed o every longitudinal side. Every connecting block comprises two dovetail halves which are formed together on their narrow sides, whereby the dovetail projections of all the blocks are of the same dimension. A set of building blocks wherein the block area of a frontal block has a surface displaced downwardly relative to the front block side and a recess from the top forms a hollow framework. At a face stone area, the hollow is bounded by a rounded base edge which follows into a tongue unit and the hollow penetrates in the tongue unit. Such hollow permits planting foliage within the dry wall constructed with such concrete blocks.

The intermediary spaces into which the dovetail parts engage are as important of an aspect of this invention as the dovetail parts themselves. When the joint is formed between the frontal block and the anchoring or connecting block, an expansion joint is formed between the building stones. The dovetail of one anchoring block is capable of holding two adjacent blocks to one another which thus stabilizes the expansion joint.

BRIEF DESCRIPTION OF THE DRAWINGS

The wall of a set of blocks in accordance with this invention is illustrated in greater detail by the drawings which illustrate an example of one preferred embodiment.

The drawings show.

DESCRIPTION OF THE PREFERRED EMBODIMENTS

Figures 1, 2, 3:
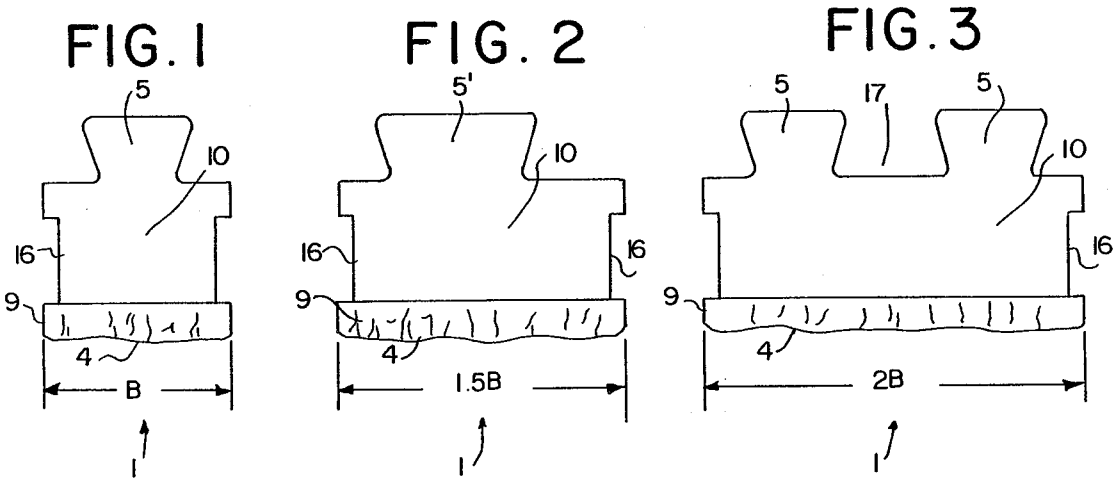
FIG. 1 is a top view of a front block having a width (B) from a building block set in accordance with one embodiment of this invention.
FIG. 2 is a top view of a frontal block having a width (1.5 B)
FIG. 3 is a top view of a frontal block having a width (2 B)

As shown in FIG. 1, the frontal block (1) of the building blocks set in accordance with this invention includes a forward frontal stone area (9) with a front surface (4) which has a texture of a natural stone and a width (B). The rear of front surface (4) is connected to a block area (10) at a smooth, even surface. At its rear side, block area (!0) has at least one dovetail projection (5) for anchoring the frontal block (1) within additional anchoring block (2) or in corresponding wall blocks. Rectangular recesses (16) are located on both lateral surfaces of the block area (10). Rectangular recesses (16) on the sides of the frontal block (1) create, with adjacent blocks, hollow spaces which in a completely constructed wall offer shelter for all types of small animals. Another embodiment of a frontal block (1) of the set of wall blocks as shown in FIG. 2 has 1 ½ times the width (B) of the base block as shown in FIG. 1. The dovetail projection (5') is enlarged 50 percent and positioned asymmetrically. With a block according to such embodiment, it is possible to construct the block connection in a more flexible manner.

FIG. 3 shows another embodiment of a wall block having a double width (2 B). Two dovetail projections (5), which form a dovetail intermediary space (17), are symmetrically positioned on the rear side of block area (10).

Figure 4:
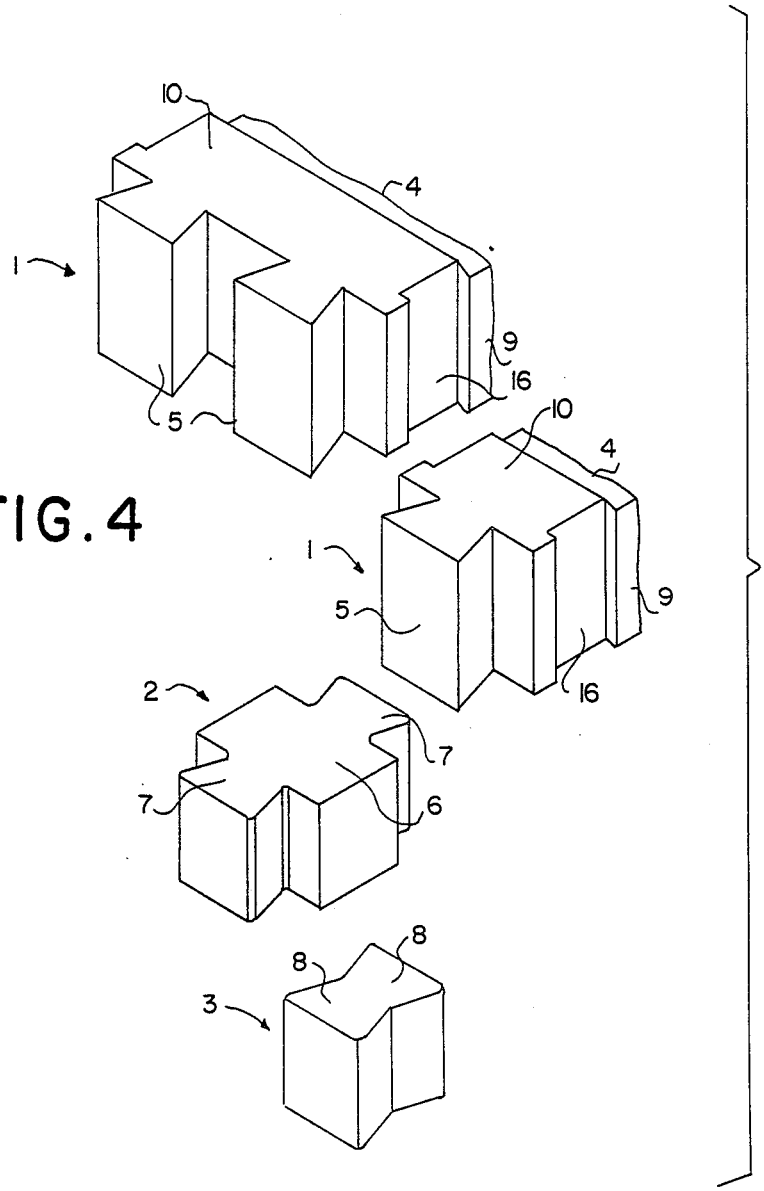
FIG. 4 is an exploded perspective view of two frontal blocks, one anchoring block, and one connecting block.

FIG. 4 shows an exploded perspective view of all three types of blocks of the wall block set in accordance with this invention. At the top of FIG. 4, two frontal blocks (1) are shown. The frontal blocks (1) typically have front stone areas (9) which are textured like natural stone on the front surface (4). Stone areas (9) are connected with block areas (10) which have a slightly raised surface. Furthermore, recesses (16) are seen as part of the side of block areas (10). In order to anchor frontal blocks (1) and thereby secure a sloped terrain by means of a dry wall constructed from frontal blocks (1), the dovetail projections (5) are integrally formed on the rear sides of block areas (10). One anchoring block (2) is shown in FIG. 4 beneath both frontal blocks (1). Anchoring block (2) is essentially constructed from one rectangular cut block (6) having dovetail projections (7) that correspond to the gaps between dovetail projections (5) on frontal block (1). Dovetail projections (7) are integrally formed on both longitudinal sides of the cut block (6). Anchoring block (2) as shown in FIG. 4 has half the height of a frontal block (1). Connecting block (3) as shown in FIG. 4 also has half the height of a frontal block (1). Connecting block (3) is constructed from two dovetail halves (8) which are dimensioned the same as projections (5, 7) on the frontal block (1) and the anchoring block (2).

Figure 5:
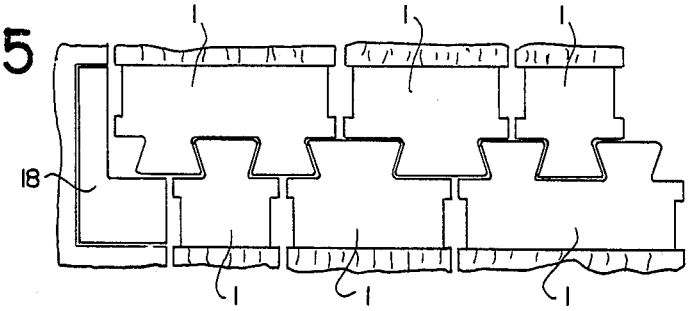
FIG. 5 is a top view of a double-faced dry wall constructed with frontal blocks.

FIG. 5 shows a top view of a double-faced dry wall with frontal blocks (1) in accordance with one embodiment of this invention. Several frontal blocks (1) in accordance with this invention are shown mutually fitting into one another with dovetail projections (5). The dovetail projections (5) on the rear side of the frontal blocks (1) thus provide for a clean, form-locking connection of frontal blocks (1) that face opposite one another, even if frontal blocks (1) are positioned somewhat at a distance from one another. Thus frontal blocks (1) are positioned in a joint-forming manner. This type of wall provides for a relatively slight construction depth which corresponds to the thickness of the wall. A special sealing element (18) can be used as a sealing cover element for a horizontal wall edge.

Figure 6:
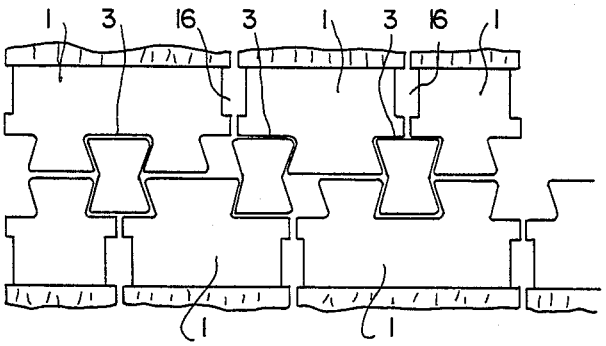
FIG. 6 is a top view of a double-faced dry wall constructed with frontal blocks and connecting blocks.

As shown in FIG. 6, connecting blocks (3) are inserted into the dovetail intermediary space (17), and the wall thickness is slightly increased.

Figure 7:
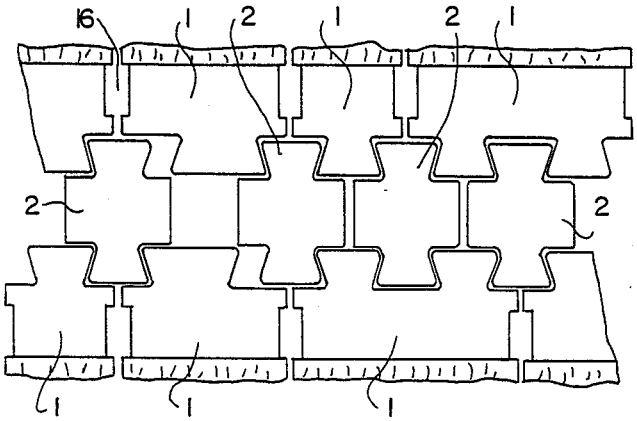
FIG. 7 is a top view of a double-faced dry wall constructed with frontal blocks and anchoring blocks.

As shown in FIG. 7, anchoring blocks (2) are inserted into the dovetail intermediate spaces. The wall thickness is thus somewhat greater. It is apparent that anchoring blocks (2) and connecting blocks (3) can be used in combination, and even be used to construct several rows thereof. Thus the wall thickness may be varied.

The recesses (16) on the expansion sides of frontal blocks (1) make it possible for all types of small animals to creep into the wall.

Figure 8:
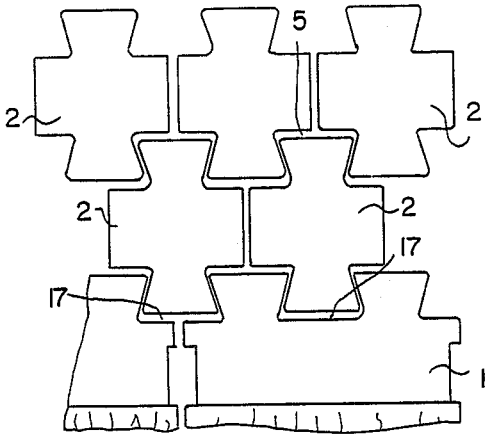
FIG. 8 is top view of a single-faced dry wall constructed with anchoring blocks.

FIG. 8 shows one embodiment of an anchoring of a single-faced wall constructed on a sloped terrain. The dovetail projections and the frontal blocks (1) and anchoring blocks (2) are positioned at a distance in a joint-forming manner. The intermediary spaces (17) in which the dovetail projections (5) engage are as important as the dovetail projections themselves. The cross-sectional surface of one dovetail projection (5) precisely corresponds to the cross-sectional surface of intermediary space (17) when two stones are positioned together in a close fitting manner.

If a joint exists between the anchoring blocks (2) or the connecting blocks (3), then an expansion joint exists between the frontal blocks (1). In a frontal block (1) having the width (1.5 B), the width of the dovetail projection (5') is adjusted to the greater distance. Normally, the distance of the dovetail projections is equal to one-half the width of the stone edge.

Figure 9:
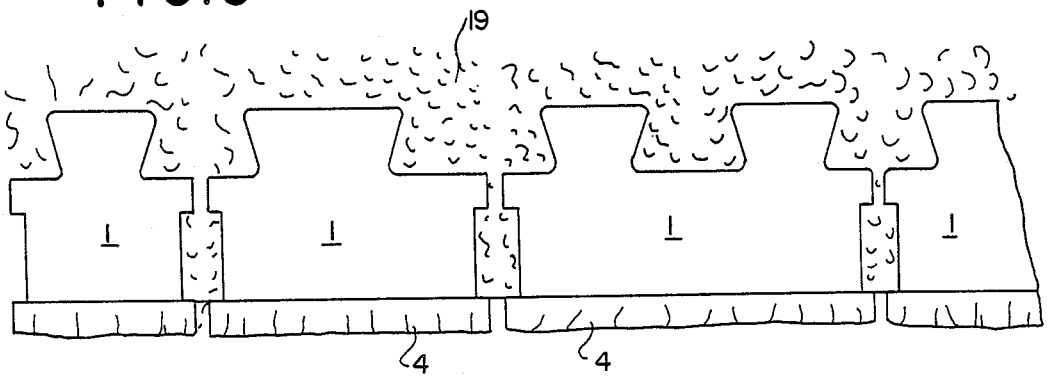
FIG. 9 is a top view of a wall segment of frontal blocks with concrete to the rear of the blocks.

FIG. 9 shows one embodiment for the construction of a prefabricated wall element according to this invention, in which the wall blocks are filled in and held together, on a work side, from behind with a rear concrete layer (19).

Figure 10:
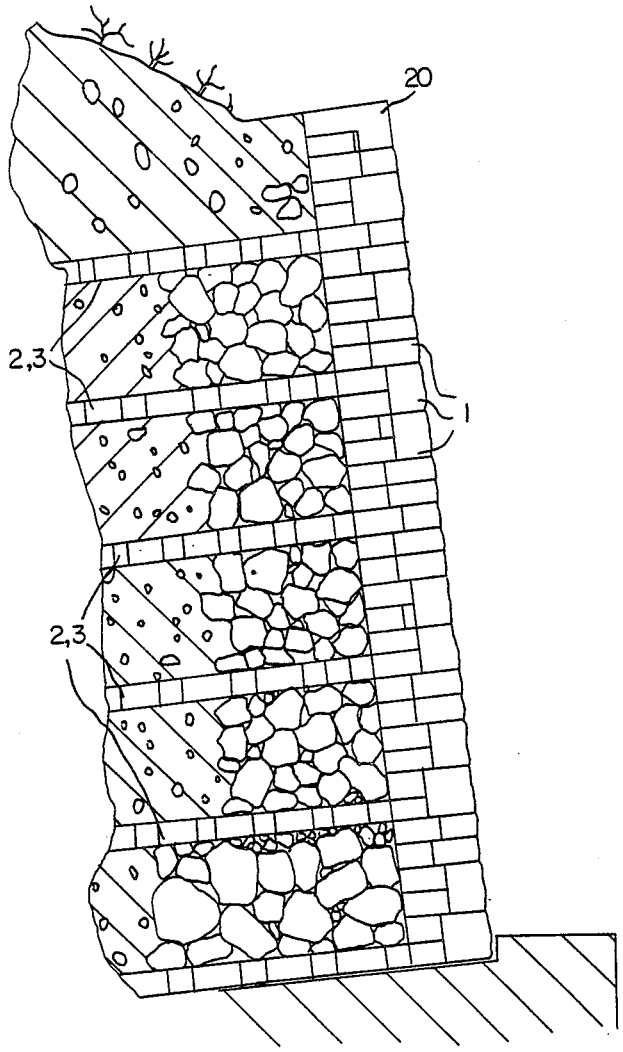
FIG. 10 is a partial cross-sectional side view of a wall completely constructed as a statically-stressed support wall for securing a sloped terrain.

FIG. 10 shows a partial cross-sectional side view of a wall constructed with the wall block set according to one embodiment of this invention. It is apparent that, for the anchoring in the ground area and in six different levels, the anchoring blocks (2) and connecting blocks (3) provide a solid anchoring of the wall in the ground. The depth of such statically-stressed wall can be adjusted according to computational requirements through the use of several anchoring blocks (2) and connecting blocks (3) placed behind one another as anchoring blocks.

Figure 11:
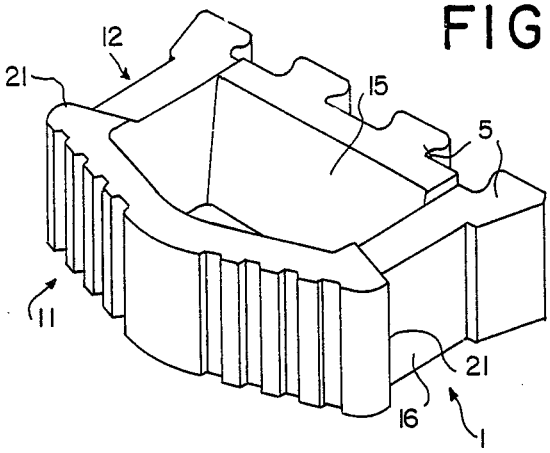
FIG. 11 is a perspective front view of a frontal block with a planting container.

One particularly attractive frontal block of a wall block set in accordance with this invention is shown in FIG. 11, in a perspective view from the front. The face stone area (11) is slightly curved back against the front. However, not only is the face stone area (11) slightly curved back, but the rear side (21) is also slightly set back relative to the stone area (12) and is slightly curved back in the reverse direction. Such curves have advantages in construction as well as aesthetics. Blocks formed in such manner can each be placed next to one another and displaced relative to one another by half the width of a block so that the frontal side of the upper block engages on the rear side (21) of the face stone area (11) of the lower block. With an even displacement of the wall, the blocks abut flatly on one another in a closely-fitting manner. If the wall front is curved, then there is at least one linear placing together, regardless of whether the wall front is curved in a convex or in a concave manner. This is one construction advantage. Regarding the aesthetics, it is apparent that because of the back curve of the frontal side of the wall block, the complete wall front further visually appears opened up because various primary frontal surface directions are created. This curved back design contributes to a natural appearance, particularly in curved wall fronts, because no excessively noticeable regularity is present. As an additional feature, the wall block shown here has a container for planting foliage within the completely erected wall. The wall block has a penetrating recess so that it essentially forms a type of hollow framework (15).

Figure 12:
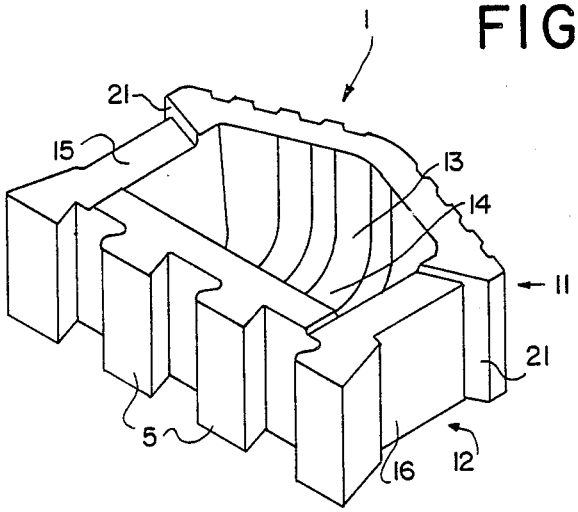
FIG. 12 is a perspective rear view of a frontal block with a planting container.

As FIG. 12 shows, a rounded base edge (13) is formed in connection with the face stone area (11) in the hollow framework (15). Rounded base edge (13) proceeds into a tongue unit (14) beyond which the recess penetrates. Furthermore, the hollow framework (15) slightly bulges out in the face stone area (11). If such wall blocks are layered on one another and displaced by half their width, then openings exist between two rows of blocks, from which foliage planted into the containers can grow out. Such plant growth, if so desired, can completely cover up the wall front.

Figure 13:
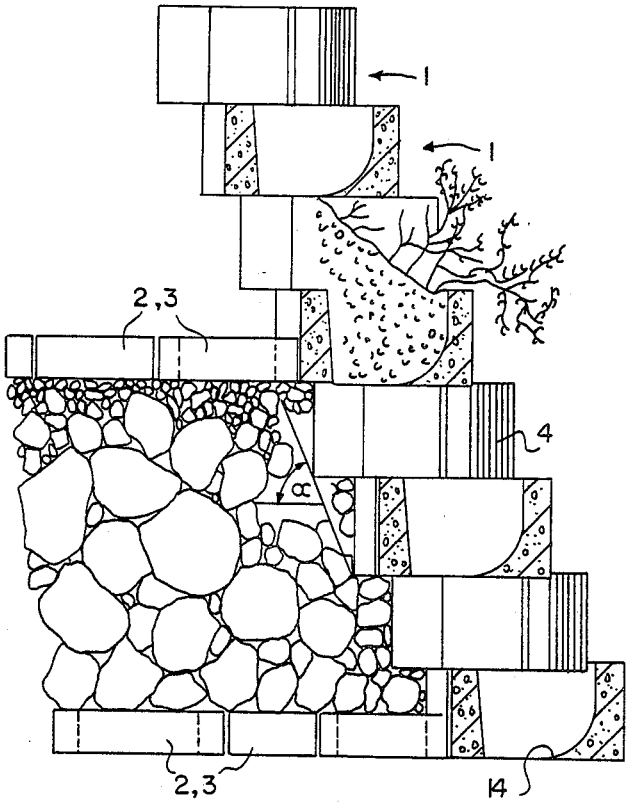
FIG. 13 is a partial cross-sectional view of a secured sloped terrain with a dry wall having plantable frontal blocks.

FIG. 13 shows a partial cross-sectional view of a constructed inclined wall. As shown in such embodiment according to this invention, each container formed within the block is filled with earth, as is shown in the embodiment. The tongue unit (14) keeps the earth in the forward area of the container and does not allow it to slip out and downward. The frontal block shown in FIG. 13 has dovetail projections (5) on its rear side and recesses (16) on the sides. The entire inclined wall is secured in the slope with anchoring blocks (2) and connecting blocks (3). The present wall block set permits construction without mortar of single-faced or double-faced dry walls having various depths. The anchoring system is particularly suited for retaining an inclined wall and the sloped terrain is optimally secured. In the construction having a container for the foliage, the wall block set in accordance with this invention is best suited for constructing straight, convex, or concavely curved inclination walls.

I claim:

1. A set of interlocking concrete blocks for the construction of a mortarless wall, comprising: frontal blocks (1) of different widths, anchoring blocks (2) for effecting an anchoring of said front blocks (1) in an earth substrate, and connecting blocks (3) for effecting a close connection of opposed said front blocks (1); each said frontal block (1) having a structured front side (4) and on its rear side at least one frontal block dovetail projection (5) relative to a top view; each said anchoring block (2) in said top view having a rectangular cross section (6) with anchoring block dovetail projections (7) integrally formed on each longitudinal side; each said connecting block (3) comprising two dovetail halves (8) formed together at a narrow die of each said dovetail half (8); and said front block dovetail projections (5), said anchoring block dovetail projections (7) and said dovetail halves (8) each having same dimensions.

2. A set of concrete blocks in accordance with claim 1, wherein said frontal block (1) has a stone face (9) having a natural stone texture, a block area (10) of said frontal block (1) being slightly offset relative to said stone face (9), said block area (10) having a rectangular recess (16) on each of two surfaces.

3. A set of concrete blocks in accordance with claim 1, wherein a block area (12) of said frontal block (1) has a downwardly displaced surface area relative to a face stone area (11) and said frontal block (1) is recessed from a top forming a hollow framework (15), a hole in said hollow framework (15) being bound by a rounded base edge (13) of said hollow framework (15) which proceeds into a tongue unit (14), and said hollow framework (15) penetrates into said tongue unit (14).

4. A set of concrete blocks in accordance with claim 2, wherein a first height of said anchoring block (2) and said connecting block (3) corresponds to a second height of said frontal block (1) in higher said block area (10).

5. A set of concrete blocks in accordance with claim 3, wherein a first height of said anchoring block (2) and said connecting block (3) corresponds to a second height of said frontal block (1) in lower said block area (12).

6. A set of concrete blocks in accordance with claim 3, wherein said anchoring block (2) having said rectangular cross section (6), and said anchoring block dovetail projections (7) which fit into intermediary spaces (17) of said frontal blocks (1) are fastened at a length of said anchoring block (2) that corresponds to said first width (B) of said frontal block (1).

7. A set of concrete blocks in accordance with claim 2, wherein said anchoring block (2) having said rectangular cross section (6), and said anchoring block dovetail projections (7) which fit into intermediary spaces (17) of said frontal blocks (1) are fastened at a length of said anchoring block (2) that corresponds to said first width (B) of said frontal block (1).

8. A set of concrete blocks in accordance with claim 1, wherein said anchoring block (2) having said rectangular cross section (6), and said anchoring block dovetail projections (7) which fit into intermediary spaces (17) of said frontal blocks (1) are fastened at a length of said anchoring block (2) that corresponds to said first width (B) of said frontal block (1).

9. A set of interlocking concrete blocks for construction of a mortarless wall, comprising: frontal blocks (1), anchoring blocks (2) for effecting an anchoring of said frontal blocks (1) in an earth substrate, and connecting blocks (3) for effecting a close connection of opposed said frontal blocks (1); each frontal block (1) having a structured front side (4) and on its rear side at least one frontal block dovetail projection (5) relative to a top view, said frontal block (1) further comprising a first frontal block (1) having a first width (B) forming a base block, said frontal block (1) having a second frontal block (1) having a second width (1.5 B) about one and one-half times said first width (B) of said base block; said second frontal block dovetail projection (5) about one and one-half times wider than a first frontal block dovetail projection displaced asymmetrically to one side of said second frontal block (1) and said frontal block (1) having a third frontal block (1) having a third width (2 B) about two times said first width (B) of said base block; each said anchoring block (2) in said top view having a rectangular cross section (6) with anchoring block dovetail projections (7) integrally formed on each longitudinal side; each said connecting block (3) comprising two dovetail halves (8) formed together at a narrow side of each said dovetail halve (8); said front block dovetail projections (5), said anchoring block dovetail projections (7) and said dovetail halves (8) each having same dimensions.

10. A set of concrete blocks in accordance with claim 9, wherein said anchoring block (2) having said rectangular cross section (6), and said anchoring block dovetail projections (7) which fit into intermediary spaces (17) of said frontal blocks (1) are positioned at a length of said anchoring block (2) corresponds to said first width (B) of said first frontal block (1).

11. A set of interlocking concrete blocks for construction of a mortarless wall, comprising frontal blocks (1), anchoring blocks (2) for effecting an anchoring of said frontal blocks (1) in an earth substrate, and connecting blocks (3) for effecting a close connection of opposed said frontal blocks (1); each frontal block having a structured front side (4) and on its rear side at least one frontal block dovetail projection (5) relative to a top view, said frontal block (1) further comprising: a first block (1) having a first width (B) forming a base block, said frontal block having a second width (1.5 B) about one and one-half times said first width (B) of said base block, said second frontal block (1) having a second frontal block dovetail projection (5) about one and one-half times wider than a first frontal block dovetail projection displaced asymmetrically to one side of said second frontal block (1) and said frontal block (1) having a third frontal block (1) having a third width (2 B) about two times said first width (B) of said base block; each said anchoring block (2) in said top view having a rectangular cross section (6) with anchoring block dovetail projections (7) integrally formed on each longitudinal side; each said connection block (3) comprising two dovetail halves (8) formed together at a narrow side of each said dovetail half (8); and said front block dovetail projections (5), said anchoring block dovetail projections (7) and said dovetail halves (8) each having same dimension.

12. A set of concrete block in accordance with 11, wherein said anchoring block (2) having a rectangular cross section (6), and said anchoring block dovetail projections (7) which fit a intermediary spaces (17) of said frontal blocks (1) are positioned so that a length of said anchoring block (2) corresponds to said first width (B) of said first frontal block (1).

13. An interlocking wall block set in accordance with claim 1, wherein said dovetail halves (8) of said connecting blocks (3) interconnect with intermediate spaces (17) of said first frontal block (1).

* * * * *